US011542736B2

(12) United States Patent
Adcock

(10) Patent No.: US 11,542,736 B2
(45) Date of Patent: Jan. 3, 2023

(54) PIANO HINGES

(71) Applicant: B/E Aerospace, Inc., Winston-Salem, NC (US)

(72) Inventor: Christopher Adcock, Advance, NC (US)

(73) Assignee: B/E Aerospace, Inc., Winston Salem, NC (US)

( * ) Notice: Subject to any disclaimer, the term of this patent is extended or adjusted under 35 U.S.C. 154(b) by 0 days.

(21) Appl. No.: 17/129,822

(22) Filed: Dec. 21, 2020

(65) Prior Publication Data

US 2022/0195771 A1 Jun. 23, 2022

(51) Int. Cl.
*E05D 7/00* (2006.01)
*E05D 3/02* (2006.01)
*E05D 11/06* (2006.01)

(52) U.S. Cl.
CPC ..... *E05D 7/009* (2013.01); *E05D 3/02* (2013.01); *E05D 11/06* (2013.01); *E05Y 2800/674* (2013.01); *E05Y 2900/132* (2013.01)

(58) Field of Classification Search
CPC ..... E05D 7/009; E05D 3/02; E05Y 2900/132; E05Y 2800/674
See application file for complete search history.

(56) References Cited

U.S. PATENT DOCUMENTS 1,893,450 A * 1/1933 Shively ..... E05D 5/04 49/400
2,557,716 A * 6/1951 Allee ..... E06B 3/486 16/250
2,752,014 A * 6/1956 Watson ..... E05D 5/04 16/389
2,818,146 A 12/1957 Loughlin
3,065,496 A 11/1962 Loughlin
3,171,157 A * 3/1965 Loughlin ..... E05D 7/009 49/400
3,296,743 A * 1/1967 Curl ..... E05D 5/0215 49/382
4,186,460 A * 2/1980 Artman ..... E05D 11/06 16/374
4,748,716 A * 6/1988 Bentz ..... E05D 11/06 16/382
5,216,839 A * 6/1993 Woodruff ..... E06B 5/003 49/495.1
5,327,684 A * 7/1994 Herbst ..... E05D 7/02 16/382

(Continued)

OTHER PUBLICATIONS

Extended European Search Report issued by Examiner Xavier Remondot, of the European Patent Office, dated Apr. 19, 2022, in corresponding European Patent Application No. 21216357.0.

*Primary Examiner* — Victor D Batson
*Assistant Examiner* — Matthew J Sullivan
(74) *Attorney, Agent, or Firm* — Locke Lord LLP; Daniel J. Fiorello; Gabrielle L. Gelozin

(57) ABSTRACT

A piano hinge can include a first hinge portion configured to attach to a first door edge, the first portion having a first front face, a first jamb face extending rearward from the first front face, and one or more first hinge knuckles extending from either or both of the first front face and the first jamb face. The first front face can be configured to extend over the one or more first hinge knuckles in a lateral direction such that the first front face hides the one or more first hinge knuckles behind first front face.

18 Claims, 7 Drawing Sheets

(56) References Cited

U.S. PATENT DOCUMENTS 5,483,771 A * 1/1996 Herbst ..... E05D 5/04 49/504
5,544,595 A * 8/1996 Stephenson, III .. E05D 11/0018 16/374
6,109,711 A * 8/2000 Hoffman ..... E05D 7/009 16/366
6,276,026 B1 * 8/2001 Wille ..... E05D 11/0054 277/637
6,357,192 B1 * 3/2002 Schluter ..... E04F 19/061 52/287.1
6,622,432 B2 * 9/2003 Zacher ..... E06B 3/88 49/501
6,719,363 B2 * 4/2004 Erlandsson ..... B60R 13/0275 16/382
7,422,047 B1 * 9/2008 McDonald ..... B60R 7/04 160/229.1
7,694,915 B2 * 4/2010 Mindermann ..... E05D 11/0054 244/130
8,584,319 B1 * 11/2013 Ludin ..... E05D 7/1061 16/262
8,627,610 B1 * 1/2014 Crowther ..... E04H 1/1266 52/211
9,187,940 B2 * 11/2015 Chandler ..... E05D 3/08
9,643,543 B1 * 5/2017 Race ..... B60R 11/06
10,428,575 B2 * 10/2019 Hanratty ..... E05D 5/02
10,906,625 B2 * 2/2021 Heeren ..... E05D 11/0054
10,947,760 B2 * 3/2021 Kim ..... B60J 1/06
10,947,761 B2 * 3/2021 Todd ..... E06B 5/113
11,047,158 B2 * 6/2021 Watanabe ..... E05F 1/1215
2006/0254024 A1 * 11/2006 Yong ..... A47G 29/1201 16/270
2007/0151164 A1 * 7/2007 Marshall ..... E05D 1/04 49/397
2014/0201949 A1 * 7/2014 Morris ..... E05D 7/009 16/387
2015/0167368 A1 * 6/2015 Morris ..... E05D 7/00 16/387
2018/0266175 A1 * 9/2018 York ..... E06B 3/88
2020/0032564 A1 * 1/2020 Escure ..... E05D 3/02

* cited by examiner

PIANO HINGES

FIELD

This disclosure relates to piano hinges (e.g., for doors).

BACKGROUND

Piano hinges are very strong hinge types. However, usually the interlocking portions of the hinge members are visible, presenting aesthetic and contamination issues.

Such conventional methods and systems have generally been considered satisfactory for their intended purpose. However, there is still a need in the art for improved piano hinges. The present disclosure provides a solution for this need.

SUMMARY

A piano hinge can include a first hinge portion configured to attach to a first door edge, the first portion having a first front face, a first jamb face extending rearward from the first front face, and one or more first hinge knuckles extending from either or both of the first front face and the first jamb face. The first front face can be configured to extend over the one or more first hinge knuckles in a lateral direction such that the first front face hides the one or more first hinge knuckles behind first front face.

The piano hinge can include a second hinge portion configured to attach to a second door edge and configured to connect to the first hinge portion to rotate relative to the first hinge portion between an open position and a closed position. The second hinge portion can include a second front face configured to allow the first hinge portion to rotate relative to the second hinge portion, a second jamb face connected to the second front face and configured to be flush with the first jamb face in a closed position, and one or more second hinge knuckles extending from the second jamb face toward a front and configured to align with and pin to the one or more first hinge knuckles to allow the first hinge portion to rotate relative to the second hinge portion. The first front face can be configured to extend over the one or more second hinge knuckles.

The first front face can be continuous and planar such that the first front face can be configured to align with a door plane and to hide all hinge knuckles. The second front face can extend from the second jamb face at a non-right angle toward a front to create a gap that can be sized to allow the first hinge portion to rotate into the gap when moved to the open position.

The first front face can include an extension that extends beyond the first and second hinge knuckles. The first front face and the second front face can be configured such that the first hinge portion and the second hinge portion can rotate without contacting the first front face or extension to the second hinge portion at least to a 90 degree opening angle range between the open position and a closed position. For example, the open position can be about 150 degrees rotation from the closed position.

In certain embodiments, the extension does not contact the second front face in the open position, for example. In certain embodiments, the extension can contact a non-jamb side of the second jamb face in the open position to limit motion. In certain embodiments, in the open position, the first front face and the second front face can be parallel.

The first hinge portion can include a first back face extending from the first jamb face, wherein the back face, the first jamb face, and the first front face form a U-bracket. The second hinge portion can include a second back face extending from the second jamb face. The second front face can include an extension panel extending therefrom and configured to run parallel to the back face. In certain embodiments, the first back face and the second back face can include one or more fastener holes defined therethrough to allow the first and second hinge portions to be fastened to a respective door or structure.

In certain embodiments, a piano hinge can include any suitable embodiments of the second hinge portion as disclosed herein, e.g., as described above. The second jamb face can extend forward of a portion of the second front face. The one or more second hinge knuckles can extend from a front edge of the second jamb face toward the second front face from the second jamb face.

The second front face can be angled at a non-right angle relative to the second jamb face. A gap can be formed between the second front face and a non-jamb side of the second jamb face and/or the one or more second hinge knuckles. The second front face can connect to the second jamb face behind the one or more second hinge knuckles.

In accordance with at least one aspect of this disclosure, a door assembly can include any suitable embodiment of a piano hinge disclosed herein, e.g., as described above. The door assembly can also include a first door member attached to the first hinge portion, and a second door member attached to the second hinge portion. The first door member can be configured to rotate relative to the second door member via the piano hinge. The one or more first hinge knuckles and the one or more second hinge knuckles can be hidden from view by the first front face. The second door member can include an angle surface configured to mate flushly with the second front surface.

These and other features of the embodiments of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1:
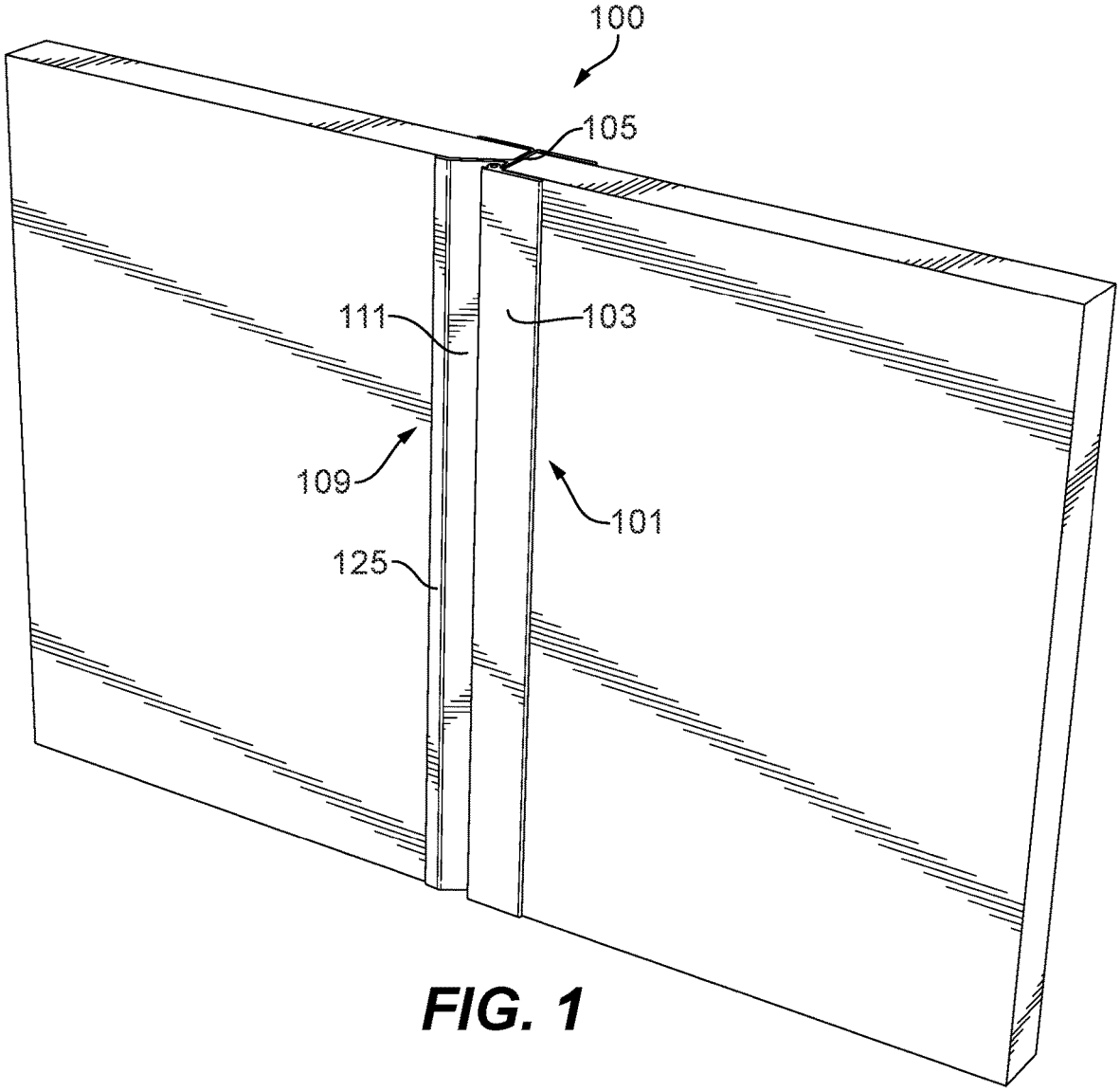
FIG. 1 is a perspective view of an embodiment of a piano hinge in accordance with this disclosure, shown disposed in a door assembly and in a closed position.

Reference will now be made to the drawings wherein like reference numerals identify similar structural features or aspects of the subject disclosure. For purposes of explanation and illustration, and not limitation, an illustrative view of an embodiment of a piano hinge in accordance with the disclosure is shown in FIG. 1 and is designated generally by reference character 100. Other embodiments and/or aspects of this disclosure are shown in FIGS. 2-8. Certain embodiments described herein can be used to provide a door hinge that can have a knuckles of the hinge hidden from view.

Referring to FIGS. 1-8, a piano hinge 100 can include a first hinge portion 101 configured to attach to a first door edge (e.g., as shown), the first hinge portion 101 having a first front face 103, a first jamb face 105 extending rearward from the first front face 103, and one or more first hinge knuckles 107 extending from either or both of the first front face 103 and the first jamb face 105. The first front face 103 can be configured to extend over the one or more first hinge knuckles 107 in a lateral direction (e.g., in a parallel plane with a door) such that the first front face 103 hides the one or more first hinge knuckles 107 behind first front face 103 (e.g., as shown when viewed from a front angle in FIGS. 1 and 2, for example). In certain embodiments, the first hinge knuckles 107 can be integrally formed with the first front face 103 and the first jamb face 105, for example (e.g., at an intersection of the first front face 103 and first jamb face 105 as shown).

Figure 2:
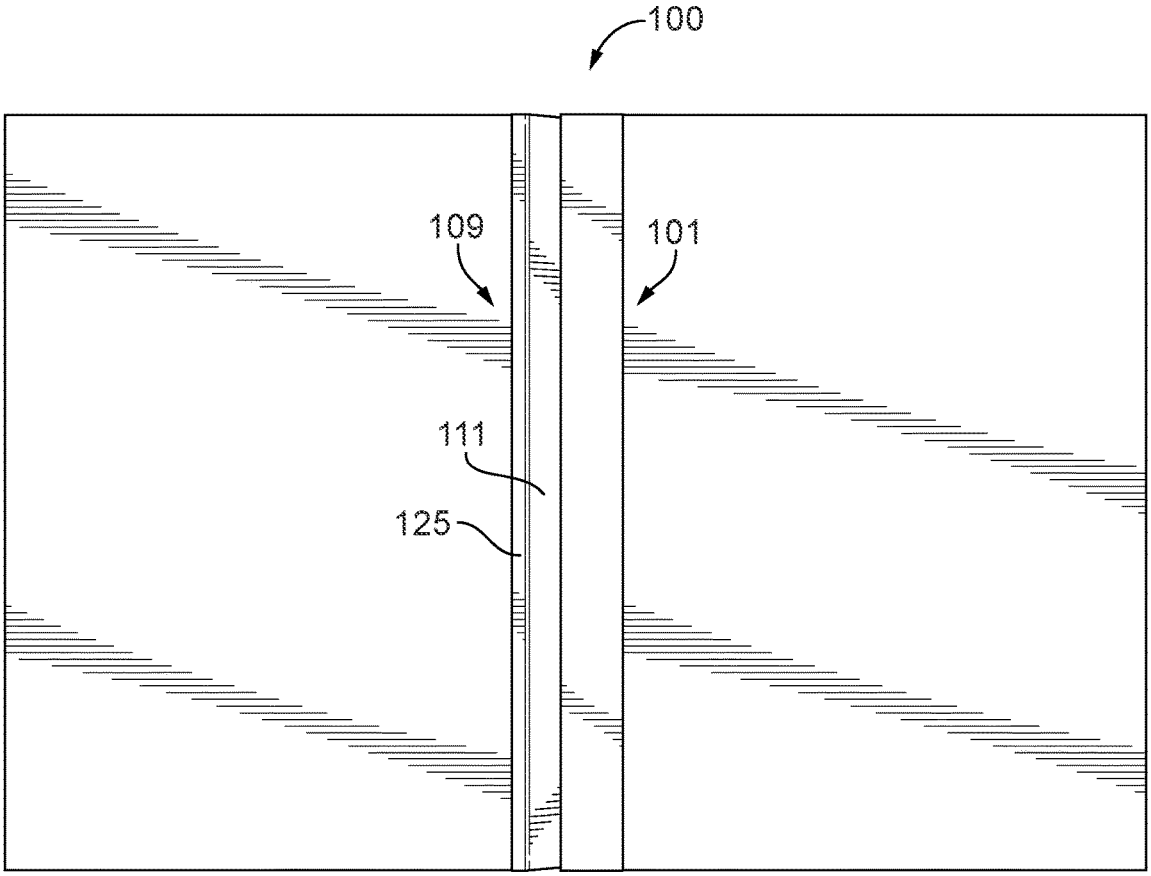
FIG. 2 is a front plan view of the embodiment of FIG. 1.
Figure 3:
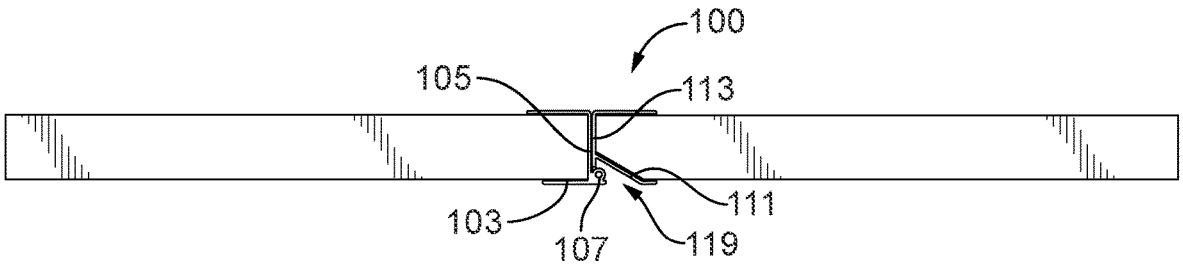
FIG. 3 is a bottom plan view of the embodiment of FIG. 1.
Figure 4:
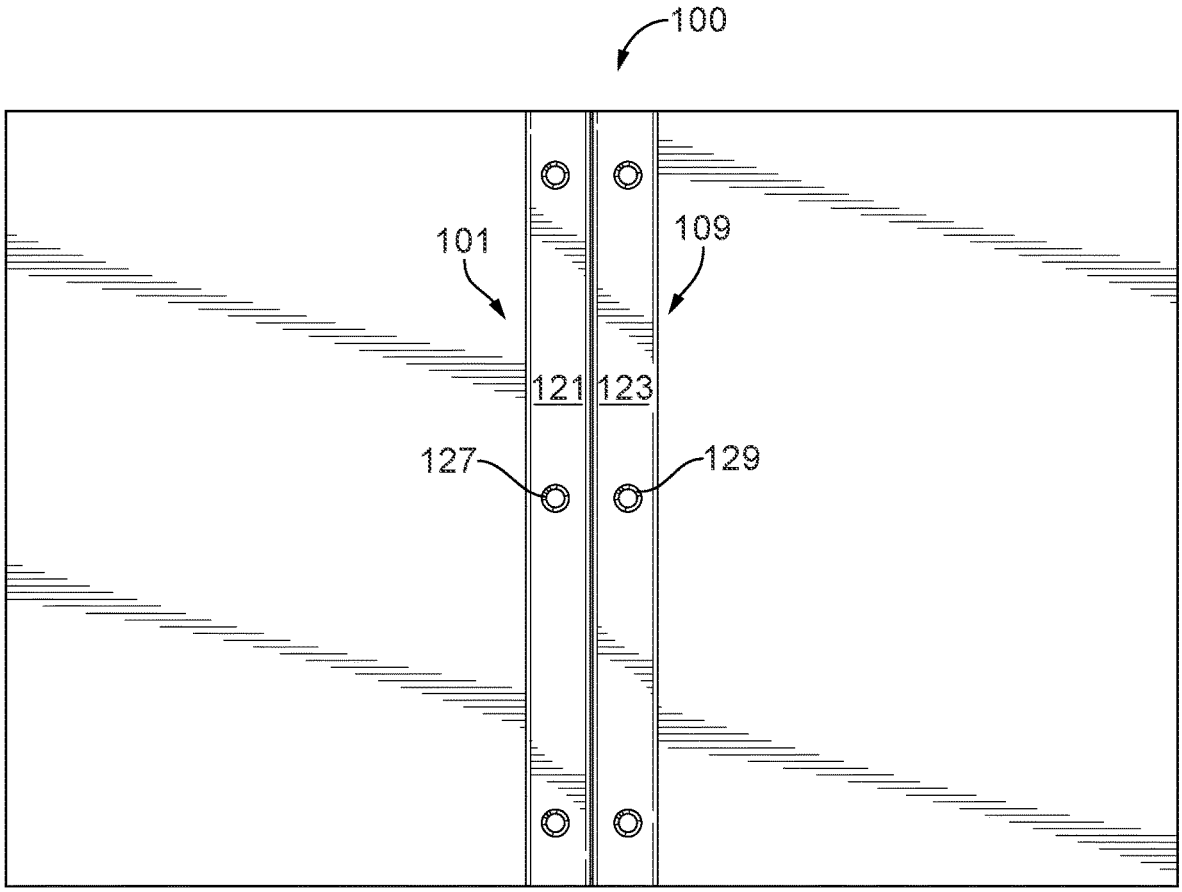
FIG. 4 is a rear plan view of the embodiment of FIG. 1.
Figure 5:
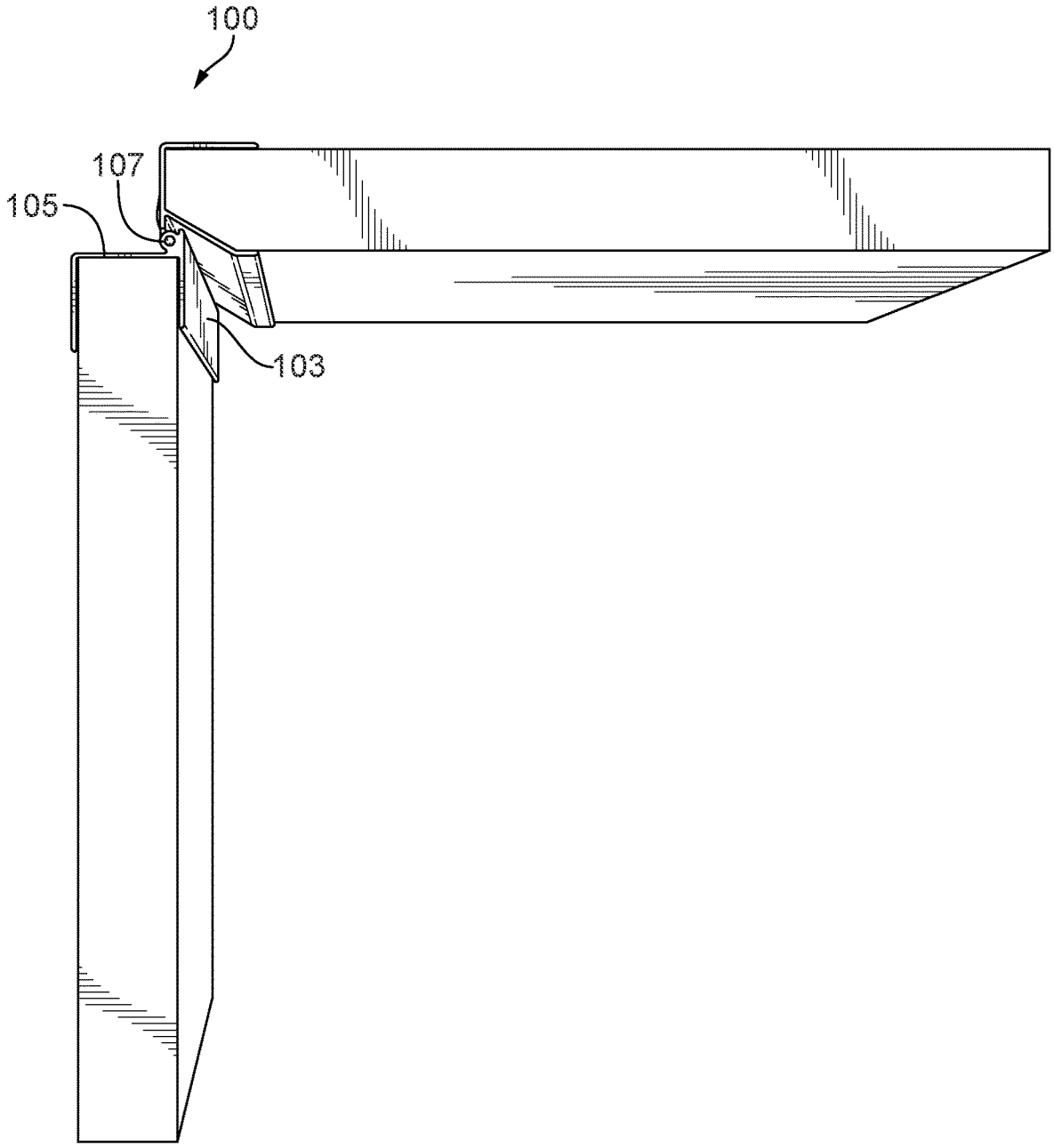
FIG. 5 is a bottom view of the embodiment of FIG. 1, shown in a position between an open position and a closed position.
Figure 6:
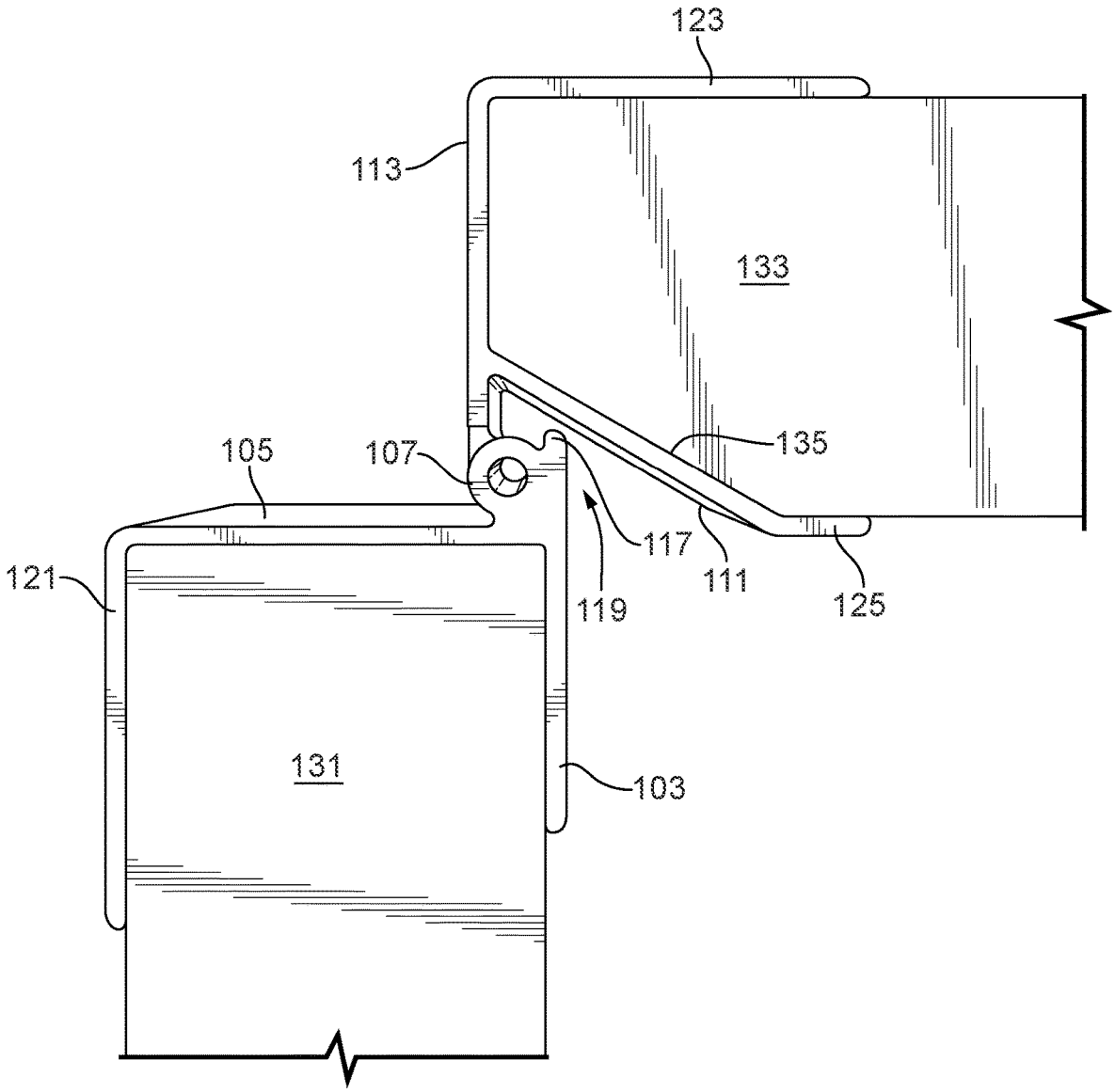
FIG. 6 is a close-up view of the embodiment of FIG. 5.
Figure 7:
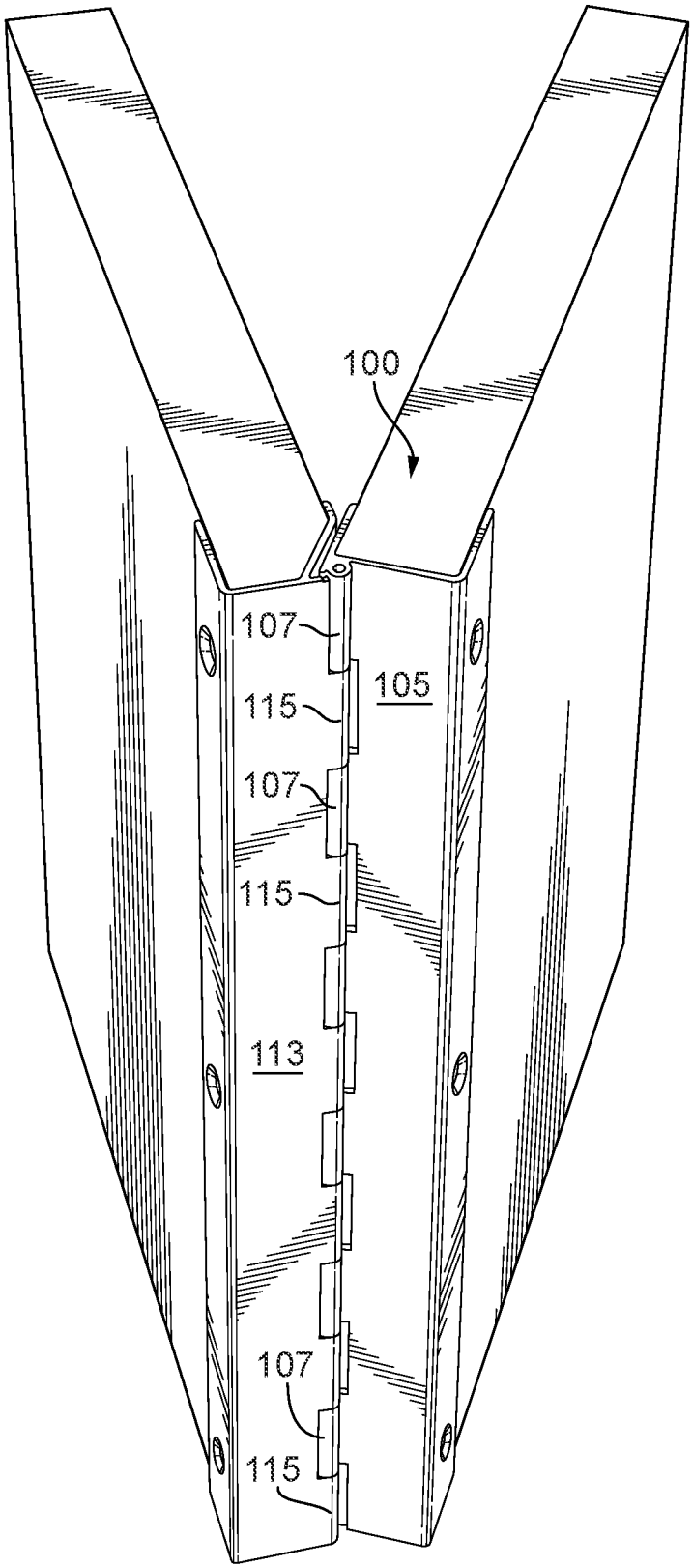
FIG. 7 is a rear perspective view of the embodiment of FIG. 1, shown in the open position.
Figure 8:
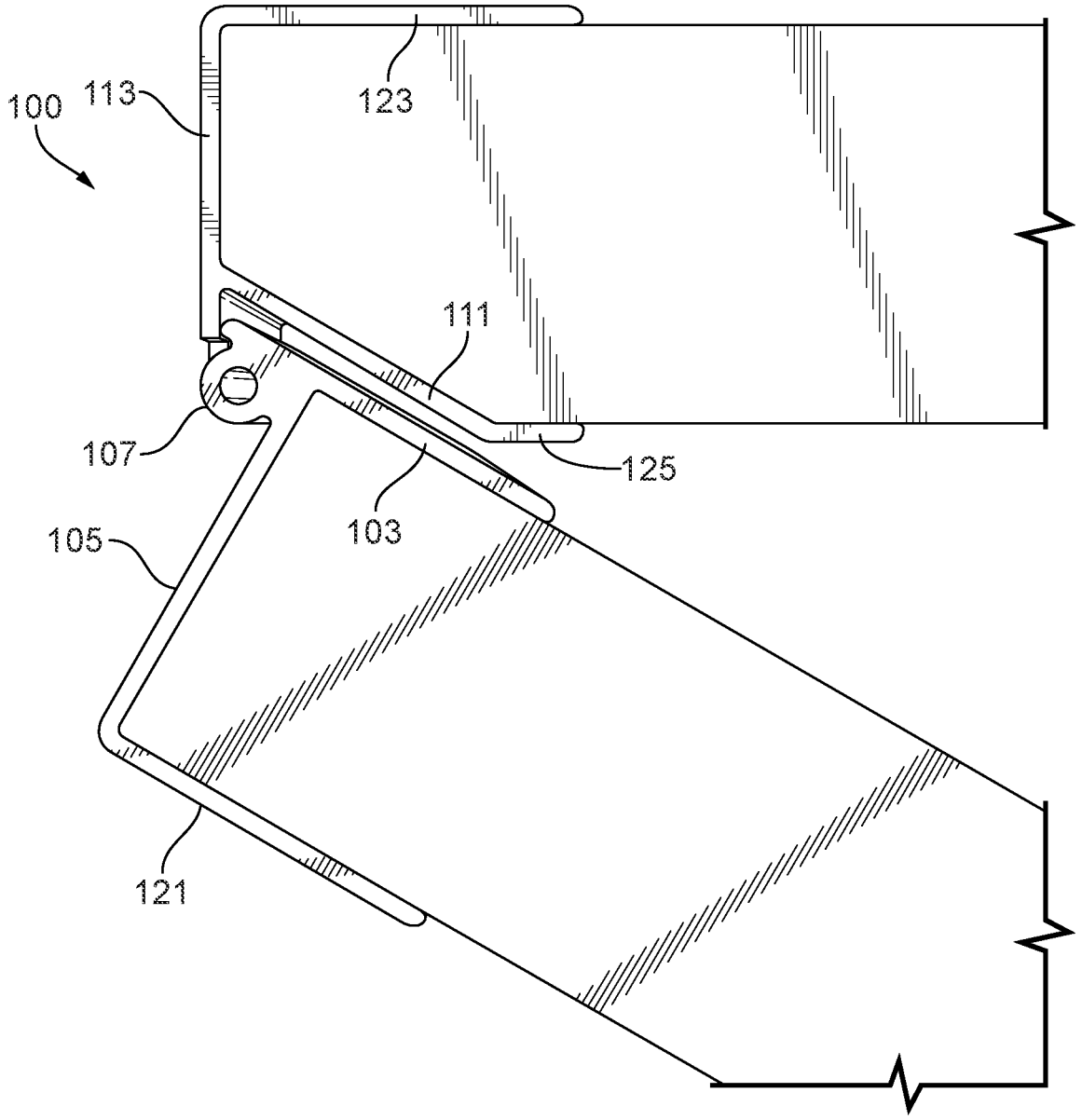
FIG. 8 is a close-up bottom plan view of the embodiment as shown in FIG. 7.

The piano hinge 100 can include a second hinge portion 109 configured to attach to a second door edge (e.g., as shown) and configured to connect to the first hinge portion 101 to rotate relative to the first hinge portion 101 between an open position (e.g., as shown in FIGS. 7 and 8) and a closed position (e.g., as shown in FIGS. 1-4). The second hinge portion 109 can include a second front face 111 configured (e.g., shaped and angled) to allow the first hinge portion 101 to rotate relative to the second hinge portion 109. The second hinge portion 109 can include a second jamb face 113 connected to the second front face 111 and configured to be flush with the first jamb face 105 in a closed position (e.g., as shown in FIGS. 1 and 4, for example). The second hinge portion 109 can include one or more second hinge knuckles 115 extending from the second jamb face 113 toward a front (e.g., as shown under the visible first hinge knuckle 107 in FIG. 6 and as can be seen in FIG. 7) and configured to align with and pin to the one or more first hinge knuckles 107 to allow the first hinge portion 101 to rotate relative to the second hinge portion 107 (e.g., about a rotational axis formed by the hinge knuckles 107, 115 when pinned together). As shown, the first front face 103 can be configured to extend over the one or more second hinge knuckles 115 e.g., as can be seen in FIGS. 1 and 2 where all hinge knuckles 107, 115 are hidden from view).

As shown, for example, the first front face 103 can be continuous and planar such that the first front face 103 can be configured to align with a door plane and to hide all hinge knuckles 107, 115, for example. The second front face 111 can extend from the second jamb face 113 at a non-right angle (e.g., as shown) toward a front to create a gap 119 (e.g., as shown in FIGS. 3 and 6) that can be sized to allow the first hinge portion 101 to rotate into the gap 119 when moved to the open position (e.g., as shown in FIG. 8).

The first front face 103 can include an extension 117 that extends beyond the first and second hinge knuckles 107, 115 (e.g., forming a peninsula shape as shown in FIG. 6). The first front face 103 and the second front face 111 can be configured such that the first hinge portion 101 and the second hinge portion 109 can rotate without contacting the first front face 103 or extension 117 to the second hinge portion 109 (e.g., to the second front face 111) at least to a 90 degree opening angle range between the open position and a closed position. For example, the open position can be about 150 degrees (e.g., as shown in FIG. 8) rotation from the closed position. Any suitable opening angle, and any suitable structural modification to the extension 117 (e.g., longer or shorter) and the second front face 111 (e.g., more or less angle relative to the second jamb face 113) to provide a narrower or broader opening angle is contemplated herein.

In certain embodiments, the extension 117 does not contact the second front face 111 in the open position (e.g., as shown in FIG. 8), for example. In certain embodiments, the extension 117 can contact a non-jamb side of the second jamb face 113 in the open position to limit motion (e.g., as shown in FIG. 8). In certain embodiments, in the open position, the first front face 103 and the second front face 111 can be parallel (e.g., as shown in FIG. 8). It is contemplated that the extension 117 and/or first front face 103 can be sized to allow the first front face 103 and the second front face 111 to contact in the open position.

The first hinge portion 101 can include a first back face 121 extending from the first jamb face 105. The back face 121, the first jamb face 105, and the first front face 103 can form a U-bracket, e.g., that fits around a substantially squared off door edge as shown. Any other suitable shape is contemplated herein.

The second hinge portion 109 can include a second back face 123 extending from the second jamb face 113. The second front face 111 can include an extension panel 125 extending therefrom and can be configured to run parallel to the second back face 123 (e.g., as shown for a squared off door edge). In certain embodiments, the first back face 121 and the second back face 123 can include one or more fastener holes 127, 129 defined therethrough to allow the first and second hinge portions 101, 109 to be fastened to a respective door or structure 131, 133.

In certain embodiments, a piano hinge 100 can include any suitable embodiments of the second hinge portion 109 as disclosed herein, e.g., as described above. The second jamb face 113 can extend forward of a portion of the second front face 111, for example. The one or more second hinge knuckles 115 can extend from a front edge of the second jamb face 113, for example, and can extend toward the second front face 111 from the second jamb face 113 (e.g., as shown).

The second front face 111 can be angled at a non-right angle (e.g., about 60 degrees acute angle) relative to the second jamb face 113. A gap 119 can be formed between the second front face 111 and a non-jamb side of the second jamb face 113 and/or the one or more second hinge knuckles 115. The second front face 111 can connect to the second jamb face 113 behind the one or more second hinge knuckles 115 (e.g., as shown).

In accordance with at least one aspect of this disclosure, a door assembly can include any suitable embodiment of a piano hinge disclosed herein, e.g., piano hinge 100 as described above. The door assembly can also include a first door member 131 attached to the first hinge portion 101, and a second door member 131 attached to the second hinge portion 133. The first door member 131 can be configured to rotate relative to the second door member 133 via the piano hinge. The one or more first hinge knuckles 107 and the one or more second hinge knuckles 115 can be hidden from view by the first front face 103, for example. The second door member 133 can include an angle surface 135 (e.g., as shown in FIG. 6) configured to mate flushly with the second front surface 111 of the second hinge portion 109.

Either door member 131, 133 can be a door or a portion of a cabinet, for example, or any other suitable structure allowing one to rotate relative to the other. In certain embodiments the either or both of the door members can be panels having a skin of metal and a honeycomb structure contained therein (e.g., such that the door members are about 1 inch thick).

In embodiments, a face runs an entire length of the piano hinge and blocks view of cylindrical knuckles. Embodiments can include an extension of the flat face that can aid in blocking view without blocking motion, the size and/or shape of which can be tuned for any suitable opening angle (e.g., 150 degrees as shown). The knuckles can be made smaller (if acceptable for loads) to reduce the extension size while still blocking view and also allow larger opening. Embodiments can include an angled face across from the extension to allow hiding of the cylindrical knuckles while still allowing proper motion of the hinge.

Embodiments can be made of extruded aluminum, with machined out knuckles and other features. A suitable rod (e.g., steel or aluminum) can then be inserted into the knuckles to form the hinge. Any other suitable materials and/or components are contemplated herein.

Embodiments can provide two mating extrusions (e.g., aluminum alloy), connected with a central circular pin along the length of the hinge spine to create a pivot point. Both extrusions halves can cover the front, side, and back edges of the panels/doors they are mounted to (with any suitable shaped faces, e.g., conformal to the door or structure it is to be mounted to). The front can be fashioned in such a way as to hide the alternating hinge knuckles, for example.

Embodiments can hide the most visibly objectionable portion, the alternating knuckles of the hinge itself, along with the edges of the door panels with more aesthetically pleasing trim-like caps. Certain embodiments can allows a door to open from 0 to about 150 degrees.

Those having ordinary skill in the art understand that any numerical values disclosed herein can be exact values or can be values within a range. Further, any terms of approximation (e.g., "about", "approximately", "around") used in this disclosure can mean the stated value within a range. For example, in certain embodiments, the range can be within (plus or minus) 20%, or within 10%, or within 5%, or within 2%, or within any other suitable percentage or number as appreciated by those having ordinary skill in the art (e.g., for known tolerance limits or error ranges).

The articles "a", "an", and "the" as used herein and in the appended claims are used herein to refer to one or to more than one (i.e., to at least one) of the grammatical object of the article unless the context clearly indicates otherwise. By way of example, "an element" means one element or more than one element.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of."

Any suitable combination(s) of any disclosed embodiments and/or any suitable portion(s) thereof are contemplated herein as appreciated by those having ordinary skill in the art in view of this disclosure.

The embodiments of the present disclosure, as described above and shown in the drawings, provide for improvement in the art to which they pertain. While the subject disclosure includes reference to certain embodiments, those skilled in the art will readily appreciate that changes and/or modifications may be made thereto without departing from the spirit and scope of the subject disclosure.

What is claimed is:

1. A piano hinge, comprising:

a first hinge portion configured to attach to a first door edge, the first portion comprising:

a first front face;

a first jamb face extending in a direction away from the first front face; and one or more first hinge knuckles extending from either or both of the first front face and the first jamb face, wherein the first front face is configured to extend over the one or more first hinge knuckles in a lateral direction such that the first front face hides the one or more first hinge knuckles behind first front face; and a second hinge portion configured to attach to a second door edge and configured to connect to the first hinge portion to rotate relative to the first hinge portion between an open position and a closed position, the second hinge portion comprising:

a second front face configured to allow the first hinge portion to rotate relative to the second hinge portion;

a second jamb face connected to the second front face and configured to be flush with the first jamb face in a closed position; and one or more second hinge knuckles extending from the second jamb face toward a front and configured to align with and pin to the one or more first hinge knuckles to allow the first hinge portion to rotate relative to the second hinge portion, wherein the first front face is configured to extend over the one or more second hinge knuckles, wherein, in the open position, the first front face and the second front face are parallel.

2. The piano hinge of claim 1, wherein the first front face is continuous and planar such that the first front face is configured to align with a door plane and to hide all hinge knuckles.

3. The piano hinge of claim 1, wherein the second front face extends from the second jamb face at a non-right angle toward a front to create a gap that is sized to allow the first hinge portion to rotate into the gap when moved to the open position.

4. The piano hinge of claim 3, wherein the first front face includes an extension that extends beyond the first and second hinge knuckles.

5. The piano hinge of claim 4, wherein the first front face and the second front face are configured such that the first hinge portion and the second hinge portion can rotate without contacting the first front face or extension to the second hinge portion at least to a 90 degree opening angle range between the open position and a closed position.

6. The piano hinge of claim 5, wherein the open position is about 150 degrees rotation from the closed position.

7. The piano hinge of claim 5, wherein the extension does not contact the second front face in the open position.

8. The piano hinge of claim 6, wherein the extension contacts a non-jamb side of the second jamb face in the open position to limit motion.

9. The piano hinge of claim 1 wherein the first hinge portion includes a first back face extending from the first jamb face, wherein the back face, the first jamb face, and the first front face form a U-bracket.

10. The piano hinge of claim 9, wherein the second hinge portion includes a second back face extending from the second jamb face, wherein the second front face includes an extension panel extending therefrom and configured to run parallel to the back face.

11. The piano hinge of claim 9, wherein the first back face and the second back face include one or more fastener holes defined therethrough to allow the first and second hinge portions to be fastened to a respective door or structure.

12. A door assembly having the piano hinge of claim 1, comprising:

a first door member attached to the first hinge portion; and a second door member attached to the second hinge portion, wherein the first door member is configured to rotate relative to the second door member via the piano hinge, wherein the one or more first hinge knuckles and the one or more second hinge knuckles are hidden from view by the first front face.

13. The door assembly of claim 12, wherein the second door member includes an angle surface configured to mate flushly with the second front surface.

14. A piano hinge, comprising:

a second hinge portion configured to attach to a second door edge and configured to connect to a first hinge portion to rotate relative to the first hinge portion between an open position and a closed position, the second hinge portion comprising:

a second front face configured to allow the first hinge portion to rotate relative to the second hinge portion;

a second jamb face connected to the second front face and configured to be flush with the first jamb face in a closed position; and one or more second hinge knuckles extending from the second jamb face toward a front and configured to align with and pin to one or more first hinge knuckles of the first hinge portion to allow the first hinge portion to rotate relative to the second hinge portion, wherein, in the open position, the first front face and the second front face are parallel.

15. The piano hinge of claim 14, wherein the second jamb face extends forward of a portion of the second front face.

16. The piano hinge of claim 15, wherein the one or more second hinge knuckles extend from a front edge of the second jamb face toward the second front face from the second jamb face.

17. The piano hinge of claim 15, wherein the second front face is angled at a non-right angle relative to the second jamb face, wherein a gap is formed between the second front face and a non-jamb side of the second jamb face and/or the one or more second hinge knuckles.

18. The piano hinge of claim 17, wherein the second front face connects to the second jamb face behind the one or more second hinge knuckles.

* * * * *